US006260690B1

(12) United States Patent
Batzer

(10) Patent No.: US 6,260,690 B1
(45) Date of Patent: Jul. 17, 2001

(54) TRANSPORT AND GATHERING SYSTEM

(75) Inventor: Josef Batzer, Stadtbergen (DE)

(73) Assignee: Bowe Systec AG, Augsburg (DE)

( * ) Notice: Subject to any disclaimer, the term of this patent is extended or adjusted under 35 U.S.C. 154(b) by 0 days.

(21) Appl. No.: 09/125,822

(22) PCT Filed: Feb. 21, 1997

(86) PCT No.: PCT/EP97/00852

§ 371 Date: May 3, 1999

§ 102(e) Date: May 3, 1999

(87) PCT Pub. No.: WO97/30924

PCT Pub. Date: Aug. 28, 1997

(30) Foreign Application Priority Data

Feb. 23, 1996 (DE) ..... 196 06 866

(51) Int. Cl.[7] ..... B65G 15/12

(52) U.S. Cl. ..... 198/626.5; 198/484.1; 198/732; 198/803.13

(58) Field of Search ..... 198/626.5, 732, 198/484.1, 803.13, 470.1, 803.1

(56) References Cited

U.S. PATENT DOCUMENTS

| | | | | |
|---|---|---|---|---|
| 1,865,750 | | 7/1932 | Elsell . | |
| 2,637,958 | * | 5/1953 | Lippmann et al. | 198/626.5 |
| 2,780,343 | * | 2/1957 | Bunnell | 198/732 |
| 3,325,977 | * | 6/1967 | Kirsten | 198/626.5 |
| 3,503,489 | * | 3/1970 | Selis | 198/732 |
| 3,812,955 | * | 5/1974 | Kopp | 198/732 |
| 4,505,093 | * | 3/1985 | Johnson | 198/732 |
| 4,508,210 | * | 4/1985 | Ramcke et al. | 198/626.5 |
| 4,537,301 | * | 8/1985 | Bavelloni | 198/732 |
| 4,571,236 | * | 2/1986 | Adams | 198/470.1 |
| 4,641,742 | * | 2/1987 | Igarashi et al. | 198/626.5 |
| 4,893,707 | * | 1/1990 | Langen et al. | 198/803.13 |
| 5,350,055 | * | 9/1994 | Lecrone | 198/732 |
| 5,657,615 | * | 8/1997 | Muller | 198/626.5 |
| 5,711,412 | * | 1/1998 | Gysin et al. | 198/732 |
| 5,899,453 | * | 5/1999 | Middelberg et al. | 271/184 |
| 5,964,461 | * | 10/1999 | Ende et al. | 198/732 |
| 6,024,207 | * | 2/2000 | Looser et al. | 198/484.1 |

FOREIGN PATENT DOCUMENTS

| | | |
|---|---|---|
| 2 254 528 | 8/1973 | (DE) . |
| 25 33 874 A1 | 2/1976 | (DE) . |
| 44 27 813 | 2/1976 | (DE) . |
| 24 56 908 A1 | 8/1976 | (DE) . |
| 203 279 | 10/1983 | (DE) . |
| 32 20 805 C2 | 12/1983 | (DE) . |
| 33 44 114 A1 | 6/1985 | (DE) . |
| 2 017 052 | 9/1979 | (GB) . |
| WO 97/30924 | 8/1997 | (WO) . |

* cited by examiner

*Primary Examiner*—Douglas Hess
(74) *Attorney, Agent, or Firm*—Beyer Weaver & Thomas, LLP

(57) ABSTRACT

A modular transport and gathering system used for moving a material to be fed (250) in a direction of transport and comprising a plurality of transport modules (A, B) having input-side and output-side end sections. Each transport module (A, B) includes a transport means in the form of an endless means (100, 110) guided over a front and a rear roll (104, 108, 114, 116), a drive (210, 212, 210', 212') for driving the transport means, and a plurality of pusher means (102) attached to the endless means at predetermined intervals, wherein said plurality of transport modules (A, B) is arranged relative to one another in such a way that a respective input-side end section of a first transport module (A) and a respective output-side end section of a second transport module (B) define an overlapping area (200) in which, over part of the length of said overlapping area (200), a respective pusher means (102) of the transport modules (A, B) defining said overlapping area (200) engages a material to be fed (250') that is to be transported, and wherein the pusher means (102) engaging the material to be fed (250') and belonging to the rear transport module (A) in the direction of transport is guided in such a way that it tilts away in a direction opposite to the direction of transport when it dives downwards upon reaching the front roll (104) of the rear transport module (A) in the direction of transport.

22 Claims, 5 Drawing Sheets

TRANSPORT AND GATHERING SYSTEM

The present invention refers to a transport and gathering system of the type used e.g. in paper processing operations. By means of such a system, packs as well as individual sheets can be transported, gathered and transferred to a subsequent machine for further processing, in a start/stop operation at a high cycle rate.

Paper transport and gathering systems are primarily used by large enterprises, banks, insurance companies, service-rendering enterprises, etc. In these enterprises, the transport and gathering systems serve to process large amounts of paper, such as invoices, reminders, statements of account, insurance policies, cheques or advertising leaflets.

Normal transport and gathering systems are provided with a continuous, driven chain or a driven transport belt, which serves to transport e.g. packs of paper sheets. The endless transport belt has arranged thereon pusher lugs arranged behind respective packs in the direction of transport. When the packs are decelerated, spreading out must be prevented by means of holding-down devices for the paper in such a transport and gathering system. The processing of different densities of packs can only be carried out by resilient or movable holding-down devices. The less uniform the density of packs is, the more critical is the processing. The endless belt or the continuous chain having the pusher lugs secured thereto must be lengthened depending on the size of the system. When the system is in operation, such lengthening is often difficult, since this has the effect that the compartment distances between the pusher lugs vary.

The transport rolls or transport belts used in known transport and gathering systems for holding down packs on the transport means are unsuitable for accelerating and decelerating thick packs or packs of different thicknesses, since, when held down by such transport rolls or transport belts, thick packs spread out when they are acclerated and decelerated. Furthermore, such holding-down devices cause dynamic problems when packs of strongly varying thicknesses are being transported.

A further disadvantage of the known transport and gathering system is to be seen in the fact that a central drive must be provided for the whole gathering path. This central drive must be designed for the maximum performance of the system. Such a transport and gathering system can no longer be enlarged when it has reached a certain degree of enlargement. All the drive elements used must be designed for maximum power transmission. This requires a very massive and heavy structrual design, e.g. due to the use of chain drives. From a certain cylce rate onwards, these known systems are, in view of their high mass, no longer suitable for a start/stop operation.

Furthermore, such a known transport and gathering system must be accelerated slowly and decelerated slowly. In the start/stop operation, this takes place over a plurality of cycles. This is the reason for the fact that an optimum through-feed rate is not achieved in the case of different collecting amounts and different cycle times resulting therefrom. When a malfunction occurs, the system is not capable of stopping immediately due to the massive drive, and this can result in a destruction of several packs located on the transport and gathering system.

Starting from the above-mentioned prior art, it is the object of the present invention to provide a transport and gathering system for moving a material to be fed in a direction of transport, said transport and gathering system being modular and theoretically expandable without limit, and the drives used in said transport and gathering system being exclusively low-mass drives.

This object is achieved by a transport and gathering system according to claim 1.

The present invention provides a transport and gathering system for moving a material to be fed in a direction of transport, comprising a plurality of transport modules having input-side and output-side end sections, each transport module having the following features:

- a transport means in the form of at least one endless means guided over a front and a rear roll;
- at least one drive for driving the transport means; and
- a plurality of pusher means attached to the transport means at predetermined intervals;
- wherein said plurality of transport modules is arranged relative to one another in such a way that a respective input-side end section of a first transport module and a respective output-side end section of a second transport module define an overlapping area in which, at least over part of the length of said overlapping area, a respective pusher means of the transport modules defining said overlapping area engages a material to be fed that is to be transported;
- and wherein the pusher means engaging the material to be fed and belonging to the rear transport module in the direction of transport is guided in such a way that it tilts away in a direction opposite to the direction of transport when it dives downwards upon reaching the front roll of the rear transport module in the direction of transport.

Preferably, each transport module comprises in addition a plurality of stopper means, each stopper means being attached to the endless means ahead of a pusher means, when seen in the direction of transport, and at a predetermined distance therefrom. The transport means of each transport module consists preferably of a plurality of endless means which are guided over rolls and which are arranged side by side in the direction of transport, whereas the pusher and stopper means consist of a plurality of pushers and stoppers, each pusher and stopper, respectively, being attached to a separate endless means.

In a preferred embodiment of the present invention, the transport means of each transport module comprises two endless means having pushers attached thereto and two endless means having stoppers attached thereto. The overlapping area is preferably formed in that the endless means of a first transport module are arranged in a first structure, gaps being formed between said endless means, and in that the endless means of a second transport module are arranged in a second structure. The respective endless means of the second transport module arranged in the second structure fit into the gaps formed by the endless means of the first transport module which are arranged in said first structure, and vice versa. In accordance with one embodiment of the present invention, the individual transport modules are secured to a carrier unit such that they can be lowered in such a way that the endless means of the various transport modules can easily be interengaged for forming the overlapping area.

According to the present invention each transport module is provided with a separate drive for driving the transport means. The transport modules represent operational modules which can be pretested and which can easily be integrated e.g. in paper handling systems even subsequently at the customer's premises. The number of modules united in one system is not limited. The drives for the individual transport modules must only be designed for the performance in their transport module. Hence, the drive is of very low mass. For this reason, a start/stopp operation can be realized in a very high performance range. An optimization of the through-feed rate in the case of varying amounts of material fed, e.g. due to different collecting amounts, can be realized in the start/stop operation in an optimum manner. According to the present invention, it is not necessary to adapt the through-feed rate to the longest feed time. Idle cycles are not necessary either. When malfunction occurs, the transport and gathering system according to the present invention can be stopped at each cycle end.

The transport and gathering system according to the present invention has a modular structural design. Using two types of transport modules, which are shown in a sectional view in FIG. 2A, a transport and gathering system of arbitrary length can be composed. For the purpose of servicing and assembly, each transport module is suspended from a guide column preferably such that it can be lowered. This guarantees access to all components. Also the endless means having pushers and stoppers secured thereto and referred to as pusher paths and stopper paths in the following have a modular structural design and can be installed in or removed from the basic transport modules as a complete unit.

Each basic transport module is provided with a separate drive for the pusher paths and the stopper paths. Hence, the driving power of the motors does not depend on the number of modules, but only on the material to be fed which is to be transported by a module. All transport elements only have to be dimensioned for the power to be transmitted in the transport module in question. The arbitrary number of combinable transport modules is based on this principle.

In accordance with a preferred embodiment according to the present invention, each transport module comprises two pusher paths and two stopper paths. Due to the low-mass structural design, a high processing performance is guaranteed in the start/stop operation. By the optional existence of pushers and stoppers, a very high cycle rate can be achieved in the start/stop operation. The material is guided during acceleration as well as during deceleration as in a compartment defined by a respective pusher means and a stopper means. Since the stopper means holds the material together during deceleration, additional holding-down devices are not even necessary when big packs are dealt with. Hence, optimum transport is achieved when individual sheets and thick packs are processed in a mixed operation. The material does not spread out during deceleration.

In the following, preferred embodiments of the present invention are explained in detail making reference to the drawings enclosed, in which:

FIG. 4A shows a side view of a pusher and FIG. 4B a side view of a stopper, and the position of said pusher and of said stopper on an endless means and relative to a guide means, whereas

Figure 1:
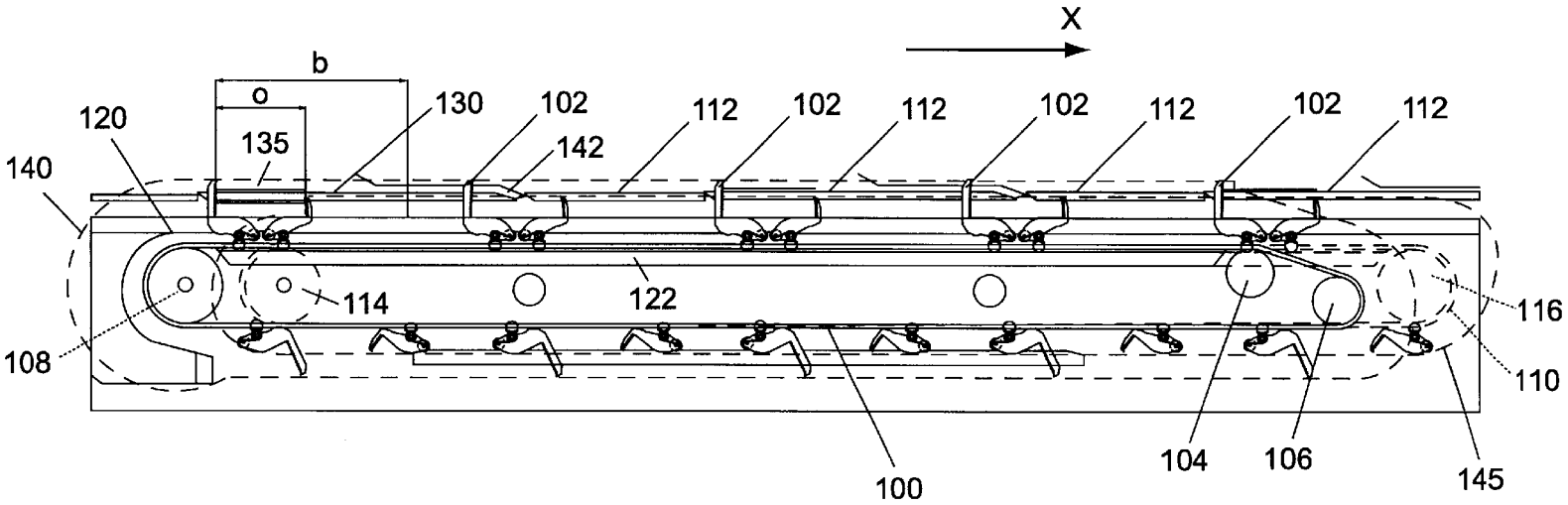
FIG. 1 shows a longitudinal section of a transport module according to the present invention.

In the following, a preferred embodiment of the present invention will be explained in detail making reference to the figures. FIG. 1 shows a longitudinal section through a transport module according to the present invention for transporting a material to be fed in a direction of transport X. The transport module according to the preferred embodiment of the present invention comprises two endless means each having arranged thereon a plurality of pushers 102. In the preferred embodiment, the endless means consist of endless belts, one of said endless belts 100 being shown in FIG. 1. The endless belt 100 is guided over rolls 104, 106, 108, said roll 108 being adapted to be driven e.g. by means of a motor. Furthermore, the transport module comprises two endless means each having arranged thereon a plurality of stoppers 112. In the preferred embodiment, also these endless means are endless belts, one of said endless belts 110 being indicated by broken lines in FIG. 1. The endless belt 110 is guided over rolls 114, 116, said roll 114, for example, being adapted to be driven by means of a motor. In the following, an endless belt having pushers attached thereto will generally be referred to as pusher path, whereas an endless belt having stoppers attached thereto will be referred to as stopper path.

In the preferred embodiment, the pushers 102 and the stoppers 112 are guided by a guide means comprising an upper guide rail for each stopper and pusher path as well as a lower guide rail for each stopper and pusher path so as to guide the movements of the stoppers and pushers. FIG. 1 shows an upper guide rail 120 associated with the endless belt 100 and a lower guide rail 122 associated with the endless belt 100. The structural design of the pushers 102, stoppers 112 and of the guide means will be explained in detail hereinbelow with reference to FIGS. 4A and 4B.

FIG. 1 additionally shows intermediate trays, one of said intermediate trays being designated by reference numeral 130. Units to be fed 135 can be positioned on this intermediate tray 130, said units 135 being intended to be added to the material to be fed between a pusher 102 and an associated stopper 112.

The broken line 140 represents the path along which the upper edge of each pusher 102 moves when the endless belt 100 is driven e.g. by means of a motor. The broken line 145 represents the path along which the parts of the stoppers 112 located furthest away from the endless belt 110 of the stopper path move. The pusher paths and the stopper paths are driven by different motors.

For transporting a material to be fed, which is arranged between a pusher and an associated stopper, the motors of the pusher paths and of the stopper paths are driven simultaneously. Whereas the stoppers 112 move in a path between the paper travelling plane, which is the upper side of the guide strip 120 in the transport module shown in FIG. 1, and the intermediate trays 130, which are also referred to as intermediate planes, the pushers, which project further above their endless belts, protrude beyond the intermediate plane. Hence, a unit to be fed 135, which is positioned on an intermediate tray 130, will be engaged by the pusher that arrives at the intermediate tray 130 after the unit to be fed 135 has been placed on the intermediate tray 130. The pusher pushes the unit to be fed 135 away from the intermediate tray 130 and over an inclined plane 142 into the compartment formed by this pusher and the stopper associated therewith, when the pusher is moved past the intermediate tray 130. The unit to be fed 135 is now arranged on the material to be fed which is already positioned in this compartment. Since the stoppers 112 project neither into the intermediate plane nor into a paper feed means arranged above the intermediate plane, a large time window exist for feeding the unit to be fed into the intermediate plane or intermediate tray.

Figure 2:
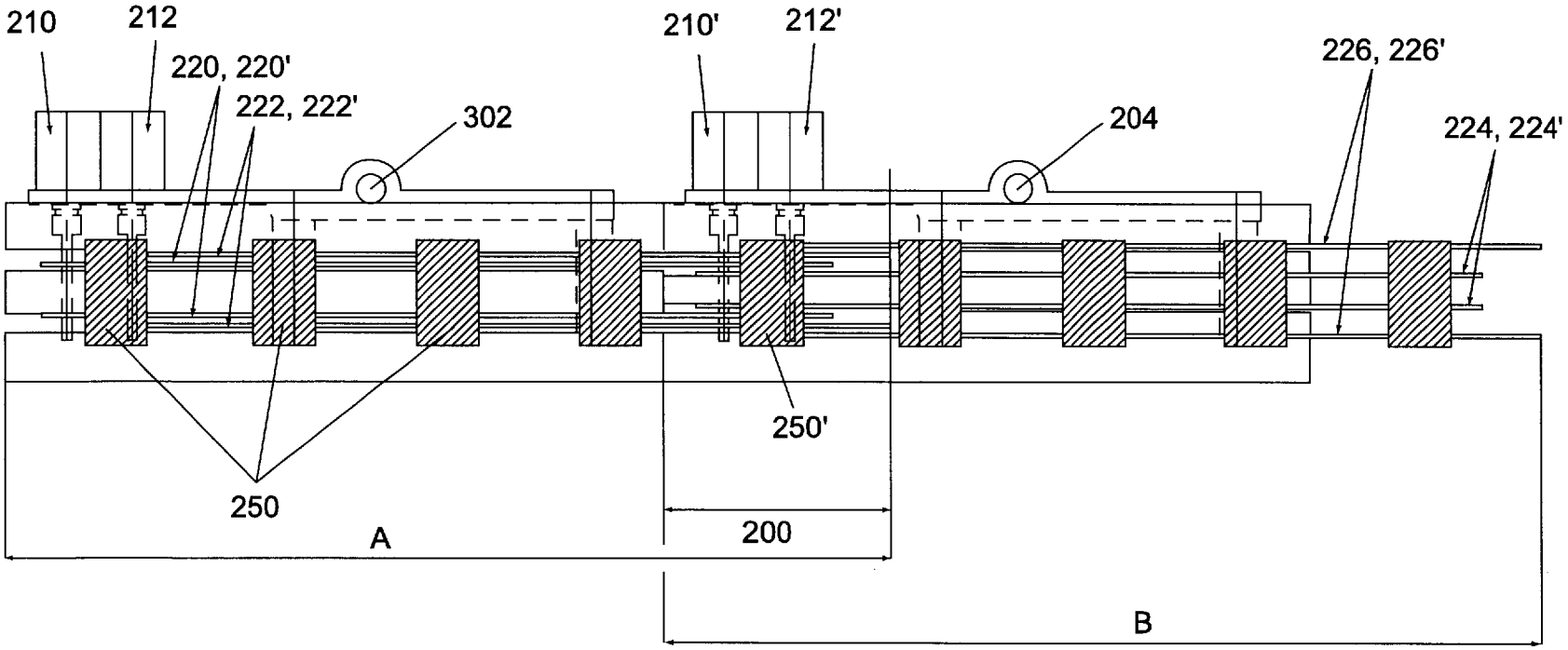
FIG. 2 shows a top view of a transport and gathering system according to the present invention which is composed of two transport modules.

FIG. 2 shows a top view of a transport and gathering system according to the present invention, which is composed of two transport modules A and B. Transport module A comprises two pusher paths 220, 220' and two stopper paths 222, 222'. Transport module B comprises two pusher paths 224, 224' and two stopper paths 226, 226'. The pusher paths 220, 220' 224, 224' and the stopper paths 222, 222', 226, 226' have an identical structural design but are arranged in different ways relative to one another, as can be best be seen in FIG. 3A, so as to permit the formation of an overlapping area 200 by an end section of transport module A on the output side and by an end section of transport module B on the input side. Transport module A is adapted to be vertically adjusted via a guide column 202, as can clearly be seen hereinbelow with reference to FIG. 3A. In the same way, transport module B is adapted to be vertically adjusted via a guide column 204. The pusher paths 220, 220' are driven via a pusher path drive 210. The stopper paths 222, 222' are driven via a separate stopper path drive 212. In the same way, the pusher paths 224, 224' are driven via a pusher path drive 210', whereas the stopper paths 226, 226' are driven via a separate stopper path drive 212'. The endless belts of the pusher and stopper paths can be toothed belts, for example, which are driven by gears attached to a shaft, said shaft being driven by a motor.

In FIG. 2, stacks of material to be fed are additionally shown, said stacks of material being moved by means of the transport modules A and B. One stack of material to be fed 250' is located in the overlapping area 200, said stack of material to be fed 250' being engaged by the pusher of transport module A as well as by the pusher of transport module B in said area.

Figure 3B:
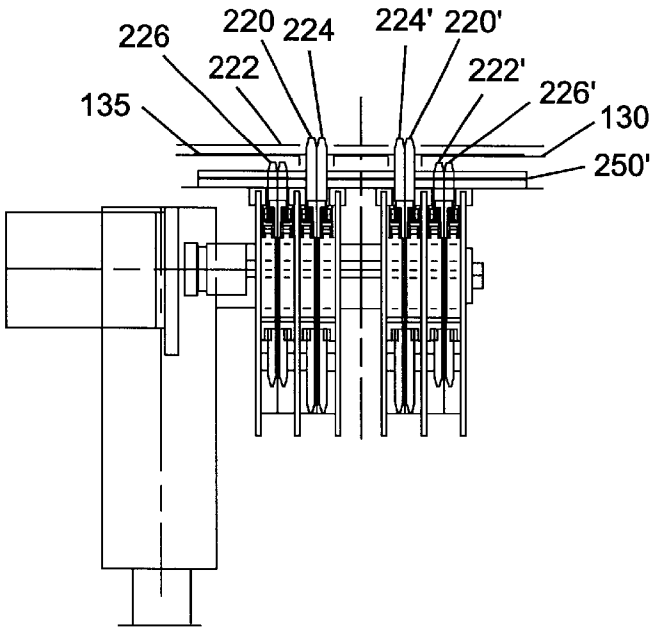
FIG. 3B shows a cross-section of the overlapping area of the transport modules of FIG. 3A, when said transport modules are combined.
Figure 3A:
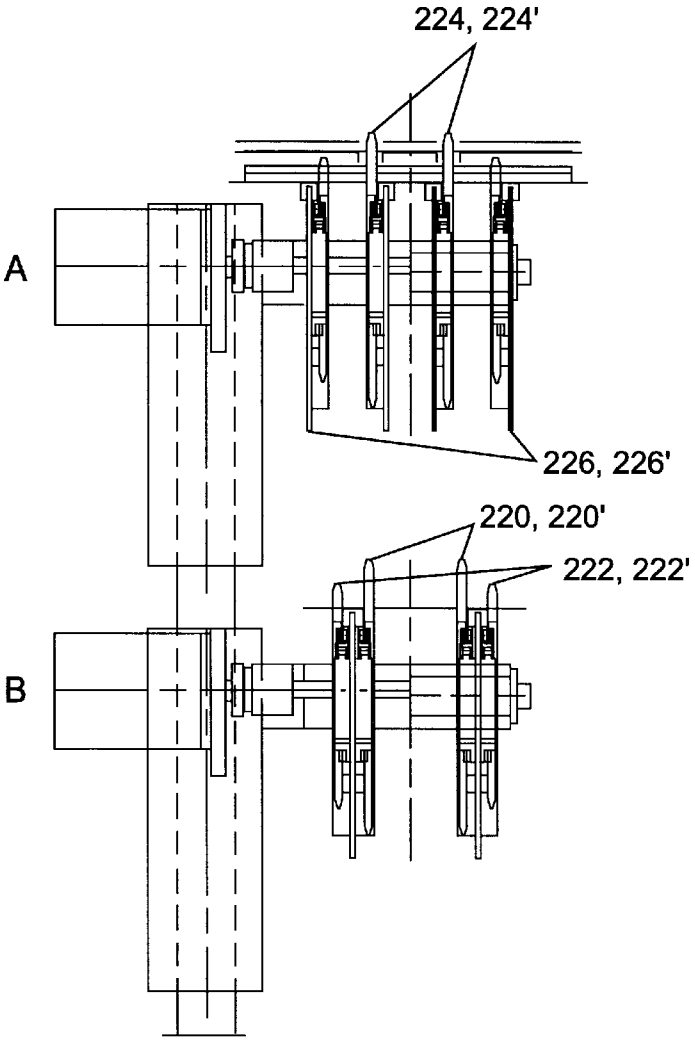
FIG. 3A shows a cross-sectional view of two transport modules according to the present invention, one transport module being lowered.

In FIG. 3A a cross-sectional view of transport modules A and B is shown. Transport module A has been lowered in height, as can, for example, be done by means of the guide column 202. The pusher paths 220, 220' and the stopper paths 222, 222' of transport module A are arranged in a parallel juxtaposed mode of arrangement in a first structure. The pusher paths 224, 224' and the stopper paths 226, 226' of transport module B are arranged in a parallel juxtaposed mode of arrangement in a second structure. The pusher paths 220, 220' of transport module A are spaced from one another with respect to a symmetry axis Y of said structures in such a way that there is room for the pusher paths 224, 224' of transport module B between said pusher paths 220, 220', as can be seen in FIG. 3B. The stopper paths 222, 222' are arranged outside of the pusher paths 220, 220' directly adjacent thereto. The stopper paths 226, 226' of transport module B are arranged outside of the pusher paths 224, 224' and are spaced from said pusher paths 224, 224' in such a way that pusher path 220 and stopper path 222 fit in between pusher path 224 and stopper path 226, whereas pusher path 220' and stopper path 222' fit in between pusher path 224' and stopper path 226'.

FIG. 3B shows a cross-section of the transport unit, which is shown in FIG. 2, in the overlapping area 200. It can clearly be seen that in the overlapping area the pushers of transport module A as well as those of transport module B are in engagement with the material to be fed 250'. In the same way, the stoppers of transport module A as well as those of transport module B are in engagement with the material to be fed 250' in the overlapping area 200. FIG. 3B additionally shows the intermediate tray 130 on which a unit to be fed 135 is positioned. As can easily be seen, the pushers are so high that they project above the intermediate tray 130, whereas the height of the stoppers is so small that said stoppers pass below the intermediate tray. As can additionally be seen, the intermediate tray 130 of the preferred embodiment is provided with gaps through which the pushers run while engaging the unit to be fed 135 which is located on said intermediate tray 130.

When a material to be fed is transferred from a transport module located at the rear in the direction of transport to a transport module located at the front in the direction of transport, it is of essential importance that, when arriving at the front roll 104 of the rear transport module in the direction of transport, the pushers of said rear transport module dive rearwards and vanish behind the material to be fed so as to avoid an undesirable acceleration of the material to be fed in the direction of transport when the pushers tip over to the front.

Figure 4C:
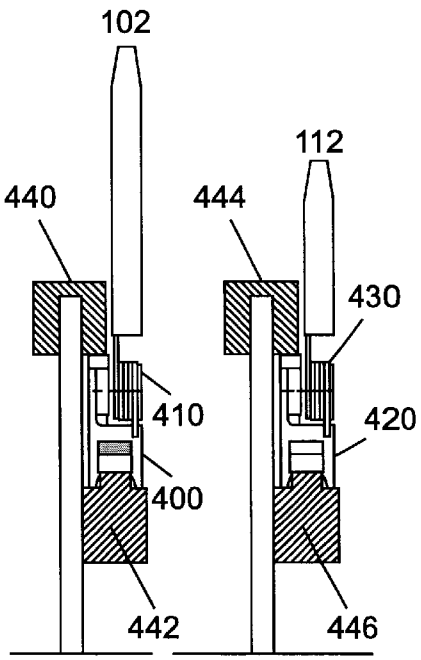
FIG. 4C shows a sectional view of a pusher and of a stopper.
Figure 4B:
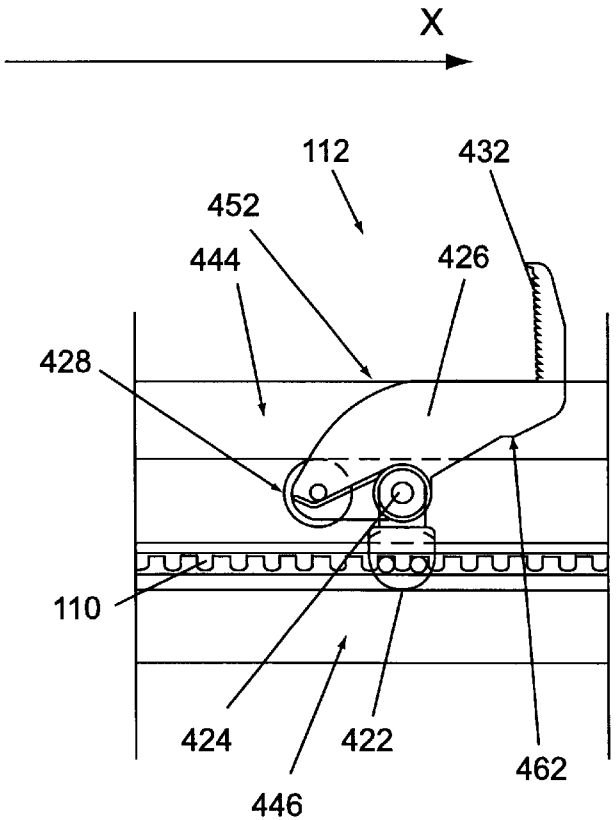
Figure 4A:
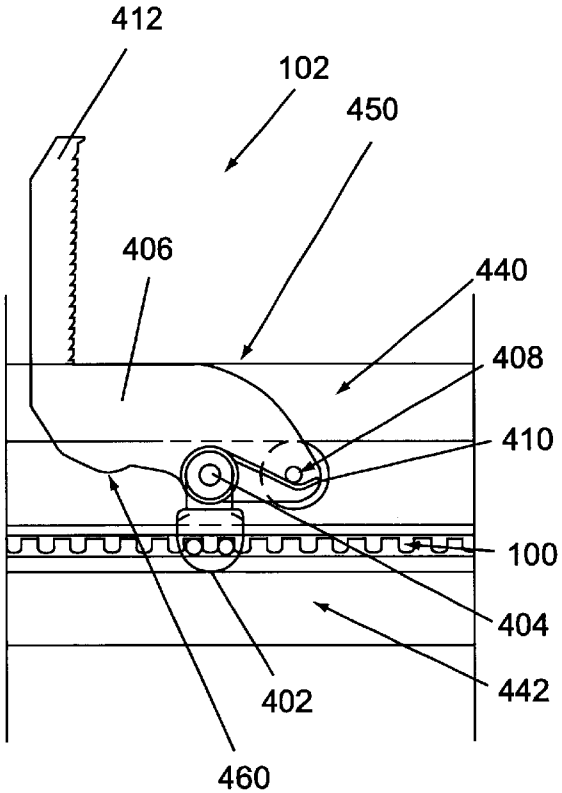

A preferred embodiment of the pusher according to the present invention is shown in FIG. 4A. A preferred embodiment of a stopper according to the present invention is shown in FIG. 4B. FIG. 4C shows sectional views of the pushers shown in FIGS. 4A and 4B.

The pusher 102 shown in FIG. 4A is provided with a component 402 which is rigidly secured to an endless belt or transport belt 100 implemented as a toothed belt in the case of the preferred embodiment. The component 402, which is rigidly secured to the transport belt 100, is connected via a pivot joint 404 to a component 406 which is adapted to be tilted relative to the transport belt. The tiltable component 406 of the pusher 102 is thus adapted to be tilted forward and backward parallel to the direction of transport. A guide roll 408 is rotatably attached to a portion of the tiltable component 406 of the pusher, said portion being located at the front when seen in the direction of transport. As can best be seen in FIG. 4C, the tiltable component 406 of the pusher is biased by means of a spring 410 relative to the pusher component 402, which is rigidly secured to the transport belt 100. The pusher is additionally provided with a section 412, which is arranged essentially at right angles to the transport belt at a transport position; said section 412 can be provided with a corrugated or serrated front surface.

FIG. 4B shows a stopper according to a preferred embodiment of the present invention. The stopper is provided with a component 422 which is rigidly secured to an endless belt or transport belt 110 implemented again as a toothed belt in the case of the preferred embodiment. This component 422, which is rigidly secured to the transport belt 110, is connected via a pivot joint 424 to a tiltable stopper component 426. By means of this pivot joint, the tiltable stopper component is adapted to be tilted forward and backward parallel to the direction of transport. A guide roll 428 is rotatably attached to a portion of the tiltable stopper component 426 which is located at the rear when seen in the direction of transport. As can best be seen in FIG. 4C, the tiltable stopper component 426 is biased with the aid of a biasing means 430, e.g. a spring, relative to the stopper component which is fixedly secured to the transport belt 110.

The tiltable stopper component is provided with a section 432, which is arranged essentially at right angles to the transport belt 110 at a transport position, said section 432 being arranged in a front portion of said stopper component when seen in the direction of transport.

The transport belts 100 and 110 of the pusher and stopper paths of the transport and gathering system according to the present invention are arranged relative to one another in such a way that a respective pusher and a respective stopper define a compartment having a predetermined length in the direction of transport. When such a compartment is defined, section 412 of the pusher is used for pushing a material to be fed, whereas section 432 of the stopper, which can also be provided with a corrugated or serrated surface facing rearwards in the direction of transport, represents in the direction of transport a forward stop for the material to be fed so as to prevent said material from spreading out.

The pusher and the stopper are guided by a guide means during their movement which is imparted thereto by the transport belts 100 and 110, respectively. The guide means for the pusher 102 consists of an upper guide strip 440 and of a lower guide strip 442. The guide means for the stopper 112 consists of an upper guide strip 444 and of a lower guide strip 446. A cross-section of these guide strips is shown in FIG. 4C. The lower guide strips 442 and 446, respectively, serve to guide the rigid components 402, 422 of the pusher and of the stopper along their path of movement, said rigid components being secured to the transport belt. Said lower guide strips 442 and 446 are provided with a central portion of elevated height (FIG. 4C). According to a preferred embodiment, the rigid components of the pusher and of the stopper are implemented such that they have two downwardly directed legs having arranged between them the respective transport belt, said legs engaging additionally between them, below the transport belt, the central portion of elevated height of the lower guide strips 442, 446. This guarantees that the rigid components of the pusher and of the stopper are reliably laterally and vertically.

The upper guide strips 440 and 444 of the guide means for the pusher and for the stopper serve to hold the tiltable components of the pusher and of the stopper in the area of the transport path, i.e. in the area where a material to be fed is transported, in a pedetermined orientation relative to the transport belt, i.e. at a predetermined transport position, i.e. an orientation at which the sections 412 of the pusher and 432 of the stopper are oriented essentially at right angles to the transport belt. The upper guide strips 440 and 444 can be implemented such that they have a flat upper surface 450 and 452, respectively, on which the material to be transported, e.g. paper, stacks of paper or packs, are guided.

The tiltable pusher component 406 and the tiltable stopper component 426 are each biased with the aid of the biasing means 410 and 430, respectively, in such a way that the guide rolls 408 and 428 of the pusher and of the stopper are forced upwards against the lower edge of the upper guide strip 440 and 444. This has the effect that the respective guide roll moves along the lower edge of the upper guide strip. The biasing means 410 of the pusher is implemented such that the pusher tilts backwards in the direction of transport when the guide roll 408 moves out of engagement with the lower edge of the upper guide strip 440. This backward tilting movement of the pusher is delimited by a rotational angle delimiting means 460 which is attached to a lower part of the tiltable pusher component 406, defining the rear part when seen in the direction of transport, and which engages the transport belt in the case of a full tilting deflection. The biasing means of the stopper is implemented such that the tiltable stopper component 426 tilts forwards in the direction of transport when the guide roll 428 moves out of engagement with the lower edge of the upper guide strip 444. This tilting is delimited by a rotational angle delimiting means 462 which is attached to a lower part of the tiltable stopper component 426 defining the front part when seen in the direction of transport and which engages the transport belt in the case of a full tilting deflection.

Figure 5:
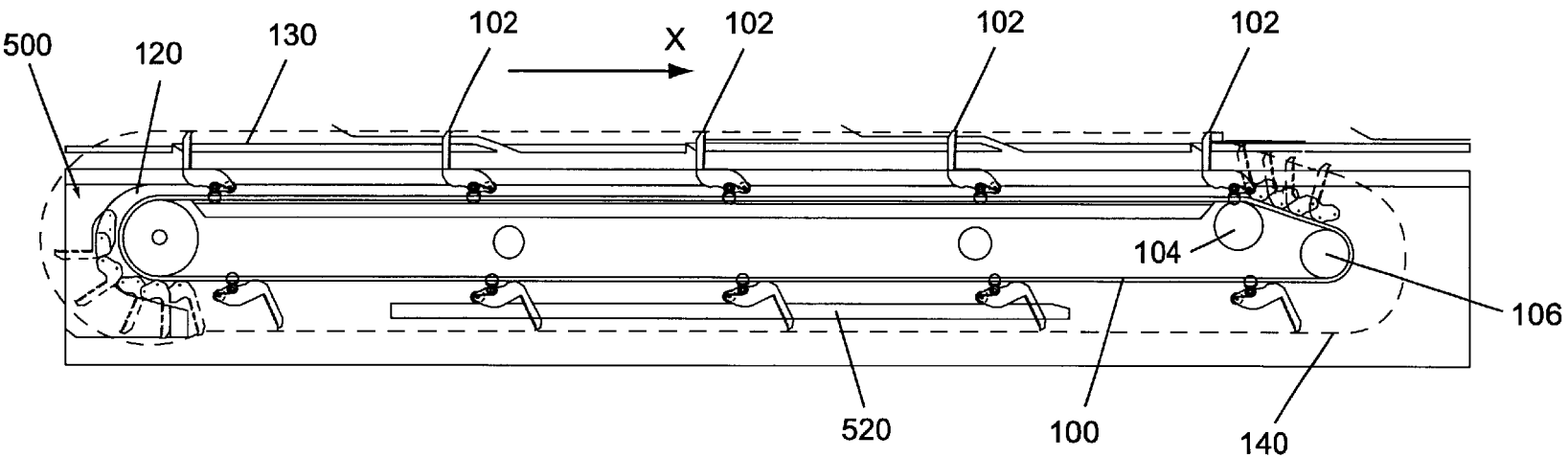
FIG. 5 shows a transport module according to the present invention in a partial longitudinal section showing an endless means, pushers secured to said endless means as well as intermediate trays.

FIG. 5 shows in an illustrative representation the curved path 140 in broken lines, said curved path being the path of movement of a pusher 102 during the movement imparted thereto by the transport belt 100. At 500, when the guide roll 408 of the pusher comes into engagement with the upper guide strip, the tiltable component 406 of the pusher moves to a position at which the section 412 thereof is orientated essentially at right angles to the transport belt. As can be seen from the figure, the guide strip 120 of the preferred embodiment is extended around the roll 108 down to the lower side of said roll in such a way that a pusher has already reached its transport position when it arrives at the transport path that begins after the rear roll 108.

The pusher then passes along the whole transport path at this position until it arrives at the front roll 104. At the front roll 104, the guide roll 408 of the pusher moves out of engagement with the upper guide strip 120. This has the effect that the tiltable pusher component 406 is drawn backwards by the biasing spring until the rotational angle delimiting means 460 of the pusher, which comes into engagement with the transport belt, stops the tilting. By means of such a pusher and guide arrangement it is therefore guaranteed that a pusher means belonging to a transport module located at the rear in the direction of transport and engaging a material to be fed tilts backwards in a direction opposite to the direction of transport when it dives downwards upon arriving at the front roll of the transport module located at the rear in the direction of transport. The material to be fed can thus be transferred to a transport module located at the front in the direction of transport without any acceleration of said material by section 412 of the pusher being caused.

In FIG. 5 a support means 520 is additionally shown, which generally serves the purpose of preventing the transport belt and the pushers 102 attached thereto from sagging when said transport belt 110 returns to the rear guide roll 108. A device of the same kind is shown for a stopper path at 620 in FIG. 6.

Figure 6:
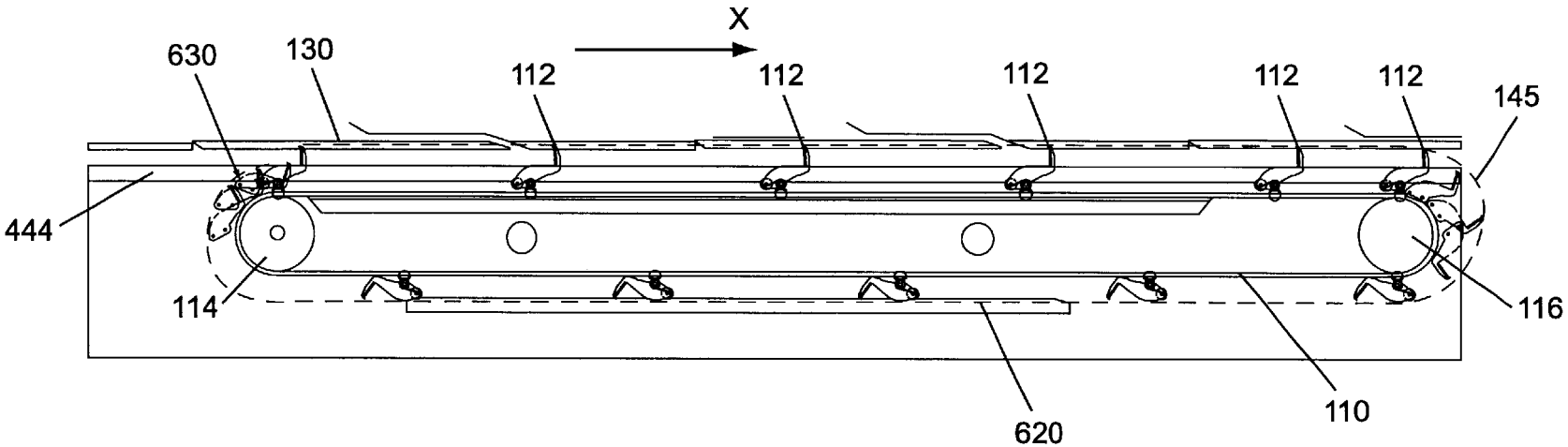
FIG. 6 shows a transport module according to the present invention in a partial longitudinal section showing an endless means, stoppers secured to said endless means as well as intermediate trays.

FIG. 6 shows in an illustrative representation the curved path of the upper end of each stopper 112, said curved path being the path of movement of said stopper during the movement imparted thereto by the transport belt. When the guide roll 528 of a stopper 112 does not come into engagement with the upper guide strip 444 of a stopper path, the stopper is biased by the biasing means 430 towards a position at which the rotational angle delimiting means 462 of the stopper rests on the transport belt. This position is occupied e.g. by the stoppers returning from the front roll 116 to the rear roll 114. The stoppers run around the roll 114 at this position, whereupon the guide roll 428 of the stopper comes into engagement with the upper guide strip 444 at point 630. This has the effect that the stopper is tilted to the position of transport at which section 432 of said stopper is arranged essentially at right angles to the transport belt. Occupying this position, the stopper passes along the transport path until the guide roll 428 of the stopper moves out of engagement with the upper guide strip when the stopper dives downwards at the front roll 116. Following this, the stopper returns to the position at which the rotational angle delimiting means 462 thereof rests on the transport belt.

It follows that the stoppers 112 are biased by their respective biasing means 430 in such a way that the tiltable part 426 thereof tilts upwards in a direction opposite to the direction of transport when the guide roll 428 of the stopper 112 comes into engagement with the upper guide strip 444 associated with the respective endless belt to which the stopper 112 is secured. It is therefore guaranteed that the stopper of a transport module located at the front in the direction of transport will not decelerate a material to be fed, which is transferred from a transport module located at the rear in the direction of transport to the front transport module, nor engage from below said material to be fed.

Figure 7:
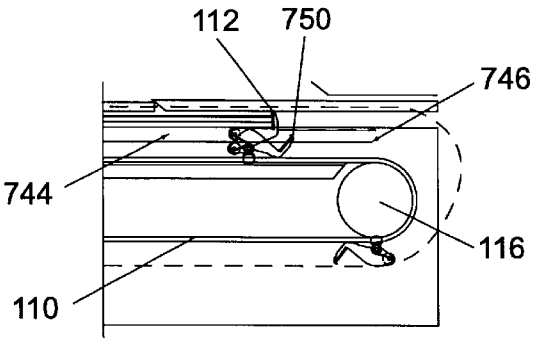
FIG. 7 shows a fragmentary view showing the front roll of a front transport module in the direction of transport.

FIG. 7 shows the rear part of a further embodiment of a stopper path including the guide roll 116 on which the transport belt 110 moves. The guide means of this stopper path differs from the guide means that has been explained with regard to the preferred embodiment of the present invention. In the case of the guide means shown in FIG. 7, the upper guide strip consists of a rigid part 744 and of a movable part 746. The movable part 746 can be raised e.g. by means of a magnet in the area of the guide roll 428. Already prior to reaching the roll 116, the stopper can in this way be forced into a position 750 at which the section 432 of said stopper is lowered below the paper travelling plane. The length of the actively adjustable guide strip portion 746 preferably corresponds at least to the length of the whole format adjustment range.

Such an actively adjustable guide strip is particularly suitable for use in a transport module arranged at the end of modular transport and gathering system. The stoppers are therefore adapted to be lowered at the outlet of the transport and gathering system in the whole format adjustment range. In this way, it is possible that a machine having transferred thereto a material to be fed from the transport and gathering system can remove said material to be fed from the transport and gathering system when said system is in operation and also when it is standing still. The transport and gathering system and the machine following said system are therefore decoupled.

Although transport modules having pusher and stopper means which comprise two pushers and two stoppers, respectively, have been described with reference to the preferred embodiment of the present invention, a pusher and stopper means according to the present invention can consist of an arbitrary number of pushers and stoppers. In the preferred embodiment two pushers have been used, which are arranged side by side on different transport belts, since this guarantees that a material to be fed, e.g. paper, is reliably pushed along the transport path. In the same way, two stoppers reliably prevent the material to be fed from spreading out.

Furthermore, arbitrary arragements of pusher and stopper paths, which exceed those shown in FIG. 3A, are possible according to the present invention as long as the pusher and stopper paths of two transport modules located one behind the other are arranged such that they permit the formation of an overlapping area.

The transport modules according to the preferred embodiment of the present invention comprise transport means having attached thereto pusher means as well as stopper means. It is, however, apparent that a modular transport and gathering system according to the present invention can be realized with transport means which do not have any stopper means.

What is claimed is:

1. A transport and gathering system for moving a material to be fed in a direction of transport, comprising a plurality of transport modules having input-side and output-side end sections, each transport module comprising:

a transport means in the form of at least one endless means guided over a front and a rear roll;

at least one drive for driving the transport means; and a plurality of pusher means attached to the endless means at predetermined intervals;

wherein said plurality of transport modules is arranged relative to one another in such a way that a respective input-side end section of a first transport module and a respective output-side end section of a second transport module define an overlapping area in which, at least over part of the length of said overlapping area, a respective pusher means of the transport modules defining said overlapping area engages a material to be fed that is to be transported;

wherein the pusher means engaging the material to be fed and belonging to a rear transport module in the direction of transport is guided in such a way that it tilts away in a direction opposite to the direction of transport when it dives downwards upon reaching the front roll of the rear transport module in the direction of transport; and wherein a plurality of stopper means is provided, a respective stopper means being associated with a respective pusher means and being tiltably arranged on at least one endless means ahead of said pusher means, when seen in the direction of transport, and at a predetermined distance therefrom, such that a pusher means and an associated stopper means define a compartment for a material disposed between the pusher means and the stopper means, wherein the length of the compartment in the direction of transport can be adjusted such that it substantially corresponds to the length of the material disposed between the pusher means and the stopper means, such that the stopper means represents a forward stop for a material and prevents the material from spreading out.

2. A transport and gathering system according to claim 1, wherein the transport means of each transport module consists of at least two parallel endless means guided over rolls, the at least one pusher means being attached to one endless means and the at least one stopper means being attached to another endless means.

3. A transport and gathering system according to claim 2, wherein the transport means of each transport module consists of four parallel endless means which are guided over rolls, and wherein the at least one pusher means consists of two pushers and the at least one stopper means consists of two stoppers, each of said two pushers and each of said two stoppers being attached to a separate endless means.

4. A transport and gathering system according to claim 3, wherein the overlapping area of the output-side end section of a first transport module and of the input-side end section of a second transport module is formed in that the endless means of the first transport module are arranged in a first structure in such a way that gaps are formed between said endless means in which the endless means of the second transport module are arranged in a second structure.

5. A transport and gathering system according to claim 1, wherein each of said plurality of transport modules is attached to a carrier unit such that it is vertically adjustable.

6. A transport and gathering system according to claim 1, wherein each transport module is additionally provided with a guide means which is arranged relative to each of said endless means in such a way that, in the area between the front and rear rolls over which each of said endless means is guided, each of the pushers and stoppers is engaged and guided by said guide means.

7. A transport and gathering system according to claim 6, wherein the guide means is additionally provided with supporting surfaces, the pushers and stoppers projecting beyond said supporting surfaces in such a way that a material to be fed, which is positioned between associated pushers and stoppers, is transported on said supporting surfaces of said guide means.

8. A transport and gathering system according to claim 6, wherein the guide means comprises a guide strip per endless means, said guide strip being arranged above the respective endless means, and wherein the pushers and the stoppers consist of a component which is adapted to be tilted parallel to the direction of movement and of a component which is rigidly secured to the endless means, said components being connected by means of a pivot joint, the tiltable component being adapted to be biased via a biasing means towards a predetermined position relative to the endless means, each pusher and stopper being provided with a guide roll which is attached to the tiltable component thereof, said guide roll being biased with the aid of the biasing means towards the first guide strip in the area of the transport path, the biasing means of each pusher means causing the tiltable component of each pusher to tilt away in a direction opposite to the direction of transport when the guide roll moves out of engagement with the guide strip.

9. A transport and gathering system according to claim 8, wherein the biasing means of each stopper means acts so as to bias the tiltable component of each stopper of the stopper means in such a way that said tiltable component of the stopper tilts upwards in a direction opposite to the direction of transport when the guide roll of the stopper comes into engagement with the guide strip which is associated with the endless means having said stopper secured thereto.

10. A transport and gathering system according to claim 8, wherein the pushers and the stoppers are implemented such that they are provided with a rotational angle delimiting means on the tiltable component thereof, said rotational angle delimiting means delimiting, when the guide roll does not engage the guide strip, a rotational movement of the pushers and of the stoppers about the pivot joint thereof, said rotational movement being caused by the biasing means.

11. A transport and gathering system according to claim 8, wherein the guide means additionally comprises a further guide strip per endless means, which is arranged below the respective endless means, said further guide strip guiding in the area of the transport path the respective component of the pushers and of the stoppers, which is rigidly secured to said endless means, and preventing the endless means from sagging.

12. A transport and gathering system according to claim 8, wherein the guide strip of an endless means having stoppers attached thereto is adapted to be lowered in an area ahead of the front roll, whereby the stopper means can be lowered below the supporting surface of the guide means in this area.

13. A transport and gathering system according to claim 1, wherein each endless means is a toothed belt guided over rolls and having attached thereto the respective pushers and stoppers.

14. A transport and gathering system according to claim 1, comprising in addition at least one intermediate tray arranged above one of the transport modules, the stoppers of this transport module projecting less far above the transport means of this transport module than the pushers of said transport module, said intermediate tray being spaced from the transport means in such a way that, when moving in the direction of transport, the stoppers pass below said intermediate tray, whereas the pushers then engage a unit to be fed which is located in said intermediate tray, said unit to be fed being positioned between the stoppers and the associated pushers.

15. A transport and gathering system for moving a material to be fed in a direction of transport, comprising a plurality of transport modules having input-side and output-side end sections, each transport module comprising:

a transport means which includes:

four parallel endless means which are guided over rolls, comprising a first set of two parallel endless means and a second set of two parallel endless means, at least one drive for driving the transport means, pusher means attached to each of the first set of two parallel endless means at predetermined intervals, stopper means attached to each of the second set of two parallel endless means at predetermined intervals, wherein each stopper means is associated with a corresponding pusher means and is tiltably arranged on the second set of two parallel endless means ahead of the corresponding pusher means, when seen in the direction of transport, and at a predetermined distance therefrom;

wherein the plurality of transport modules is arranged relative to one another in such a way that a respective input-side end section of a first transport module and a respective output-side end section of a second transport module define an overlapping area in which, at least over part of the length of said overlapping area, a pusher means of the transport modules defining the overlapping area engages a material to be fed that is to be transported, and wherein the overlapping area of the output-side end section of a first transport module and of the input-side end section of a second transport module is formed such that the endless means of the first transport module are arranged in a first structure such that gaps are formed between the endless means in which the endless means of the second transport module are arranged in a second structure;

wherein the pusher means belonging to a rear transport module in the direction of transport, engaging the material to be fed, is guided in such a way that it tilts away in a direction opposite to the direction of transport when it dives downwards upon reaching a front roll of the rear transport module in the direction of transport; and wherein the stopper means is associated with a corresponding pusher means and is tiltably arranged on of the second set of two parallel endless means ahead of corresponding pusher means when seen in the direction of transport, and at a predetermined distance from the corresponding pusher means.

16. A transport and gathering system for moving a material to be fed in a direction of transport, comprising:

a carrier unit;

a plurality of transport modules attached to the carrier unit such that the transport modules are vertically adjustable, the transport having an input-side end section and output-side end section;

each transport module further comprising:

a transport means in the form of at least one endless means guided over a front and a rear roll, at least one drive for driving the transport means, and a plurality of pusher means attached to the endless means at predetermined intervals;

wherein the plurality of transport modules is arranged relative to one another in such a way that the input-side end section of a first transport module and the output-side end section of the second transport module define an overlapping area in which, at least over part of a length of said overlapping area, a pusher means of the transport modules which define the overlapping area engages a material to be fed that is to be transported;

wherein the pusher means engaging the material to be fed and belonging to a rear transport module in the direction of transport is guided in such a way that it tilts away in a direction opposite to the direction of transport when it dives downwards upon reaching a front roll of the rear transport module in the direction of transport; and wherein a plurality of stopper means is provided such that a stopper means is associated with a corresponding pusher means and said stopper means being tiltably arranged on at least one endless means ahead of said corresponding pusher means, when seen in the direction of transport, and at a predetermined distance therefrom.

17. A transport and gathering system for moving a material to be fed in a direction of transport, comprising a plurality of transport modules having input-side and output-side end sections, each transport module comprising:

a transport means in the form of at least one endless means guided over a front and a rear roll;

at least one drive for driving the transport means; and a plurality of pusher means attached to the endless means at predetermined intervals;

wherein said plurality of transport modules is arranged relative to one another in such a way that a respective input-side end section of a first transport module and a respective output-side end section of a second transport module define an overlapping area in which, at least over part of the length of said overlapping area, a respective pusher means of the transport modules defining said overlapping area engages a material to be fed that is to be transported;

wherein the pusher means engaging the material to be fed and belonging to a rear transport module in the direction of transport is guided in such a way that it tilts away in a direction opposite to the direction of transport when it dives downwards upon reaching the front roll of the rear transport module in the direction of transport;

wherein a plurality of stopper means is provided, a respective stopper means being associated with a respective pusher means and being tiltably arranged on at least one endless means ahead of said pusher means, when seen in the direction of transport, and at a predetermined distance therefrom; and wherein, arranged above one of the transport modules, at least one intermediate tray, the stoppers of this transport module projecting less far above the transport means of this transport module than the pushers of said transport module, said intermediate tray being spaced from the transport means in such a way that, when moving in the direction of transport, the stoppers pass below said intermediate tray, whereas the pushers then engage a unit to be fed which is located in said intermediate tray, said unit to be fed being positioned between the stoppers and the associated pushers.

18. A transport and gathering system for moving a material to be fed in a direction of transport, comprising a plurality of transport modules each having input-side and output-side end sections, the transport module comprising:

a transport means in the form of at least one endless means guided over a front and a rear roll;

at least one drive for driving the transport means; and a plurality of pusher means attached to the endless means at predetermined intervals;

wherein said plurality of transport modules is arranged relative to one another in such a way that a respective input-side end section of a first transport module and a respective output-side end section of a second transport module define an overlapping area in which, at least over part of the length of said overlapping area, a respective pusher means of the transport modules defining said overlapping area engages a material to be fed that is to be transported;

wherein the pusher means engaging the material to be fed and belonging to a rear transport module in the direction of transport is guided in such a way that it tilts away in a direction opposite to the direction of transport when it dives downwards upon reaching the front roll of the rear transport module in the direction of transport;

wherein a plurality of stopper means is provided, a respective stopper means being associated with a respective pusher means and being tiltably arranged on at least one endless means ahead of said pusher means, when seen in the direction of transport, and at a predetermined distance therefrom;

wherein each transport module includes a guide means which is arranged relative to each of said endless means in such a way that, in the area between the front and rear rolls over which each of said endless means is guided, each of the pushers and stoppers is engaged and guided by said guide means; and wherein the guide means comprises a guide strip per endless means, said guide strip being arranged above the respective endless means, and wherein the pushers and the stoppers consist of a component which is adapted to be tilted parallel to the direction of movement and of a component which is rigidly secured to the endless means, said components being connected by means of a pivot joint, the tiltable component being adapted to be biased via a biasing means towards a predetermined position relative to the endless means, each pusher and stopper being provided with a guide roll which is attached to the tiltable component thereof, said guide roll being biased with the aid of the biasing means towards the first guide strip in the area of the transport path, the biasing means of each pusher means causing the tiltable component of each pusher to tilt away in a direction opposite to the direction of transport when the guide roll moves out of engagement with the guide strip.

19. A transport and gathering system according to claim 18, wherein the biasing means of each stopper means acts to bias the tiltable component of each stopper of the stopper means in such a way that the tiltable component of the stopper tilts upwards in a direction opposite to the direction of transport when the guide roll of the stopper comes into engagement with the guide strip which is associated with the endless means having said stopper secured thereto.

20. A transport and gathering system according to claim 18, wherein the pushers and the stoppers are implemented such that they are provided with a rotational angle delimiting means on the tiltable component thereof, said rotational angle delimiting means delimiting, when the guide roll does not engage the guide strip, a rotational movement of the pushers and of the stoppers about the pivot joint thereof, said rotational movement being caused by the biasing means.

21. A transport and gathering system according to claim 18, wherein the guide means additionally comprises a further guide strip per endless means, which is arranged below the respective endless means, said further guide strip guiding in the area of the transport path the respective component of the pushers and of the stoppers, which is rigidly secured to said endless means, and preventing the endless means from sagging.

22. A transport and gathering system according to claim 18, wherein the guide strip of an endless means having stoppers attached thereto is adapted to be lowered in an area ahead of the front roll, whereby the stopper means can be lowered below the supporting surface of the guide means in this area.

* * * * *